US005507148A

United States Patent [19]

Mostello

[11] Patent Number: 5,507,148

[45] Date of Patent: Apr. 16, 1996

[54] AIR SEPARATION METHOD AND APPARATUS TO PRODUCE NITROGEN

[75] Inventor: Robert A. Mostello, Somerville, N.J.

[73] Assignee: The Boc Group, Inc., New Providence, N.J.

[21] Appl. No.: 459,946

[22] Filed: May 31, 1995

Related U.S. Application Data

[63] Continuation-in-part of Ser. No. 374,060, Jan. 19, 1995, abandoned, which is a continuation-in-part of Ser. No. 329,035, Oct. 25, 1994, abandoned.

[51] Int. Cl.[6] ..... F25J 3/02

[52] U.S. Cl. ..... 62/24; 62/39

[58] Field of Search ..... 62/24, 39, 41

[56] References Cited

U.S. PATENT DOCUMENTS 4,843,828 7/1989 Gladman ..... 62/24
5,163,296 11/1992 Ziemer et al. ..... 62/39
5,349,822 9/1994 Nagamura et al. ..... 62/39
5,396,772 3/1995 McKeigue et al. ..... 62/39

*Primary Examiner*—Rondald C. Capossela
*Attorney, Agent, or Firm*—David M. Rosenblum; Larry R. Cassett

[57] ABSTRACT

An air separation method and apparatus for producing nitrogen is provided in which oxygen enriched liquid, produced as a column bottoms of a distillation column, is partially vaporized and phase separated. The vapor phase is expanded to provide refrigeration while the liquid phase, after pressure reduction, is introduced into the head condenser to condense reflux to the column. Alternatively, part of the oxygen enriched liquid can be fully vaporized and then expanded to provide refrigeration. In such case, another part of the oxygen enriched liquid can be used to condense reflux to the column. Part of the air to be separated is liquefied against the oxygen enriched liquid to be vaporized and then introduced into a lower portion of the column to maintain production and purity levels that would have been obtained had all the oxygen enriched liquid stream been used in condensing reflux to the column.

14 Claims, 2 Drawing Sheets

AIR SEPARATION METHOD AND APPARATUS TO PRODUCE NITROGEN

RELATED APPLICATIONS

This is a continuation-in-part of U.S. patent application Ser. No. 08/374,060, filed Jan. 19, 1995, now abandoned, which was a continuation-in-part of Ser. No. 08/329,035, filed Oct. 25, 1994, now abandoned.

BACKGROUND OF THE INVENTION

The present invention relates to a method of separating air by a low temperature rectification process employing a distillation column to produce a nitrogen product. More particularly, the present invention relates to such a method and apparatus in which a portion of oxygen enriched liquid produced as a column bottoms in the distillation column vaporized and then expanded to supply refrigeration and another portion of the oxygen enriched liquid, after expansion, is used to condense nitrogen vapor in a head condenser attached to the distillation column. Even more particularly, the present invention relates to such a method and apparatus in which the portion of the oxygen enriched liquid is vaporized by a part of the incoming air and under certain conditions an additional condensing stream of lesser oxygen content than air withdrawn from the distillation column. The part of incoming air and the additional condensing stream are thereby liquefied and introduced into the column as additional reflux streams to maintain the rate and/or concentration of nitrogen production to prior art levels.

Nitrogen is produced by low temperature rectification of the air in an air separation plant. Often such plants employ a single distillation column and are known in the art as nitrogen generators. After air has been filtered, compressed and purified, the air is cooled to a temperature suitable for its rectification. This temperature is normally at or near the dew point of the air. Thereafter, the air is introduced into a distillation column having liquid-vapor contacting elements which can be formed by trays and/or packings, either structured or random. In the distillation column an ascending vapor phase of the air is contacted by a descending liquid phase. The result of such contact is that the liquid phase becomes evermore concentrated in oxygen to produce a oxygen enriched liquid column bottoms and the ascending vapor phase becomes evermore concentrated in nitrogen to produce a nitrogen rich vapor tower overhead.

In order to reflux the column, a head condenser is provided in which the nitrogen vapor tower overhead is partially condensed. The condensate is returned to the distillation column as reflux. Typically, an oxygen enriched liquid stream composed of the column bottoms is removed, expanded to a low temperature, and then introduced as the coolant for the head condenser. The product is removed from the top region of the column mostly as a vapor.

In any type of air separation plant, there is continual heat leakage into the plant and enthalpy differences between the air feed and product streams at the warm end of the plant. Such heat leakage requires refrigeration to be supplied to the air separation plant. If the nitrogen product is to be maintained at column pressure, refrigeration is generally supplied from outside the column envelope. Work expansion obtained from the vaporized oxygen enriched liquid, all of which is vaporized in the head condenser, or by expanding air from a higher pressure down to column pressure are usual methods of supplying refrigeration. There are also "liquid assist plants" in which liquid nitrogen is added to the column from an external source in order to supply the requisite refrigeration.

As will be discussed, the present invention relates to an air separation technique in which refrigeration is generated in a manner that reduces the energy expenditure in producing a nitrogen product. This is accomplished by more efficiently using energy for air separation and making energy, formerly in excess, available for refrigeration.

SUMMARY OF THE INVENTION

The present invention provides a method of separating air to produce a nitrogen product. In accordance with the method, the air is separated by a low temperature rectification process employing a distillation column to produce an oxygen rich liquid column bottoms and a nitrogen rich vapor tower overhead. A head condenser is provided to condense at least part of the nitrogen rich vapor tower overhead to reflux the distillation column.

In one aspect of the present invention, the low temperature rectification process includes partially vaporizing an oxygen enriched liquid stream composed of the oxygen rich liquid column bottoms. The oxygen enriched liquid stream is thereafter separated into liquid and vapor phases and a liquid phase stream composed of the liquid phase is expanded to create a temperature difference between the liquid phase stream and the nitrogen rich vapor tower overhead. The liquid phase stream is introduced into the head condenser as a coolant stream so that heat is transferred from the at least part of the nitrogen rich vapor to the coolant stream to thereby cause the condensation of the at least part of the nitrogen rich vapor tower overhead. A vapor phase stream, composed of the vapor phase is expanded with the performance of work to produce a refrigerant stream utilized to at least partially refrigerate the low temperature rectification process. A product stream is extracted from a remaining part of the nitrogen rich vapor tower overhead, not utilized in the distillation column as the reflux, to form the nitrogen product.

In another aspect of the present invention, the low temperature rectification process includes dividing an oxygen enriched liquid stream composed of the oxygen rich liquid column bottoms into first and second partial streams. The first partial stream is expanded to create a temperature difference between the first partial stream and the nitrogen rich vapor tower overhead. The first partial stream is introduced as a coolant stream into the head condenser so that heat is transferred from the at least part of the nitrogen rich vapor to the coolant stream thereby causing condensation of the at least part of the nitrogen rich vapor tower overhead. The second partial stream is vaporized and then partially warmed after having been vaporized. The second partial stream is expanded with the performance of work to produce a refrigerant stream utilized at least to partially refrigerate the low temperature rectification process. A product stream is extracted from a remaining part of the nitrogen rich vapor tower overhead not utilized in the distillation column as the reflux to form the nitrogen product.

The present invention also provides an apparatus for separating air to produce a nitrogen product. In accordance with the apparatus, a filter is provided for filtering the air and a compressor is connected to the filter for compressing the air. An after-cooler is provided for removing heat of compression from the air and a pre-purification unit is provided for purifying the air. A main heat exchange means cools the air to a temperature suitable for its rectification and a distillation column is configured to rectify the air into an oxygen rich liquid column bottoms and a nitrogen rich vapor tower overhead. A head condenser is connected to the distillation column to condense at least part of the nitrogen rich vapor tower overhead for reflux to the distillation column.

In accordance with a further aspect of the present invention, a vaporization means is connected to the distillation column for partially vaporizing an oxygen enriched liquid stream composed of the oxygen rich liquid column bottoms and a phase separator is connected to the vaporization means for separating the oxygen enriched liquid stream into liquid and vapor phases. The phase separator is connected to the head condenser so that heat is transferred from the at least part of the nitrogen rich vapor to a coolant stream made up of a liquid phase stream composed of the liquid phase. The result is to cause condensation of the at least part of the nitrogen rich vapor tower overhead and vaporization of the coolant stream to form a vaporized coolant stream therefrom. A pressure reduction valve is interposed between the phase separator and the head condenser to expand the liquid phase stream and thereby create the coolant stream and a temperature difference between the coolant stream and the nitrogen rich vapor tower overhead. The phase separator is also connected to the main heat exchange means so that the vapor phase stream composed of the vapor phase partially warms. An expansion means is connected to the main heat exchange means for expanding the vapor phase stream with the performance of work to produce a refrigerant stream. The main heat exchange means is in communication with the expansion means so that the refrigerant stream fully warms within the main heat exchange means. A means is provided for extracting a product stream composed of a remaining part of the nitrogen rich vapor tower overhead, not utilized in the distillation column as the reflux, to form the nitrogen product and the main heat exchange means is connected to the product stream extracting means so that the product stream fully warms within the main heat exchange means.

In accordance with a still further aspect of the present invention, the head condenser is connected to the distillation column so that heat is transferred from the at least part of the nitrogen rich vapor to a coolant stream made up of a first partial stream composed of the oxygen rich liquid column bottoms. This causes the condensation of the least part of the nitrogen rich vapor tower overhead and vaporization of the coolant stream to form a vaporized coolant stream. A pressure reduction valve is interposed between the distillation column and the head condenser to expand the first partial stream and thereby create the coolant stream and a temperature difference between the coolant stream and the nitrogen rich vapor tower overhead. A vaporization means is connected to the distillation column for vaporizing a second partial stream composed of the oxygen rich liquid column bottoms. The vaporization means is also connected to the main heat exchange means so that the second partial stream partially warms. An expansion means is connected to the main heat exchange means for expanding the second partial stream with the performance of work to produce a refrigerant stream. The main heat exchange means is in communication with the expansion means so that the refrigerant stream fully warms within the main heat exchange means. A means is provided for extracting a product stream composed of the remaining part of the nitrogen rich vapor tower overhead not utilized in the distillation column as the reflux to form the nitrogen product. The main heat exchange means is also connected to the product stream extracting means so that the product stream fully warms within the meat exchange means.

The present invention functions by taking advantage of the larger-than-necessary driving forces that are employed in the distillation of air to create the nitrogen product. In the present invention, the oxygen enriched liquid acts as a coolant for condensing reflux to the column and serves to supply at least part of the refrigeration needs of the plant, independent of aforementioned typical refrigeration processes.

Since not all of the oxygen enriched liquid is being utilized in a reflux condensation role, there is potentially an insufficient supply of reflux produced by the head condenser. In order to compensate for such reduced reflux production, intermediate reflux can be supplied, at the very least, by liquid air and preferentially by both liquid air and another reflux stream of lesser oxygen content than air. Thus, in yet still another aspect, the present invention encompasses a method in which the oxygen enriched liquid stream or a part thereof is partially or wholly vaporized by indirectly exchanging heat with part of the air to be separated and preferably, with another vapor stream withdrawn from the column of lesser oxygen content than air, thereby causing the part of the air to be separated and if present, the other vapor stream to liquefy. The part of the air to be separated and preferably, the other liquefied vapor stream withdrawn from the column are then introduced into the distillation column as intermediate reflux streams to maintain production of the product stream at a level that would have been obtained had the entire oxygen rich liquid stream been utilized to condense the at least part of the nitrogen rich vapor tower overhead. Prior to the partial vaporization of the oxygen rich liquid stream or the complete vaporization of part of the oxygen enrich liquid stream, the oxygen enriched liquid is expanded to produce a temperature difference for the indirect heat exchange with the part of the air and preferably, if present, the vapor stream withdrawn from the column.

DESCRIPTION OF THE DRAWING

While the specification concludes with claims distinctly pointing out the subject matter that Applicant regards as his invention, it is believed the invention will be better understood when taken in connection with the accompanying drawing in which:

DETAILED DESCRIPTION

Figure 1:
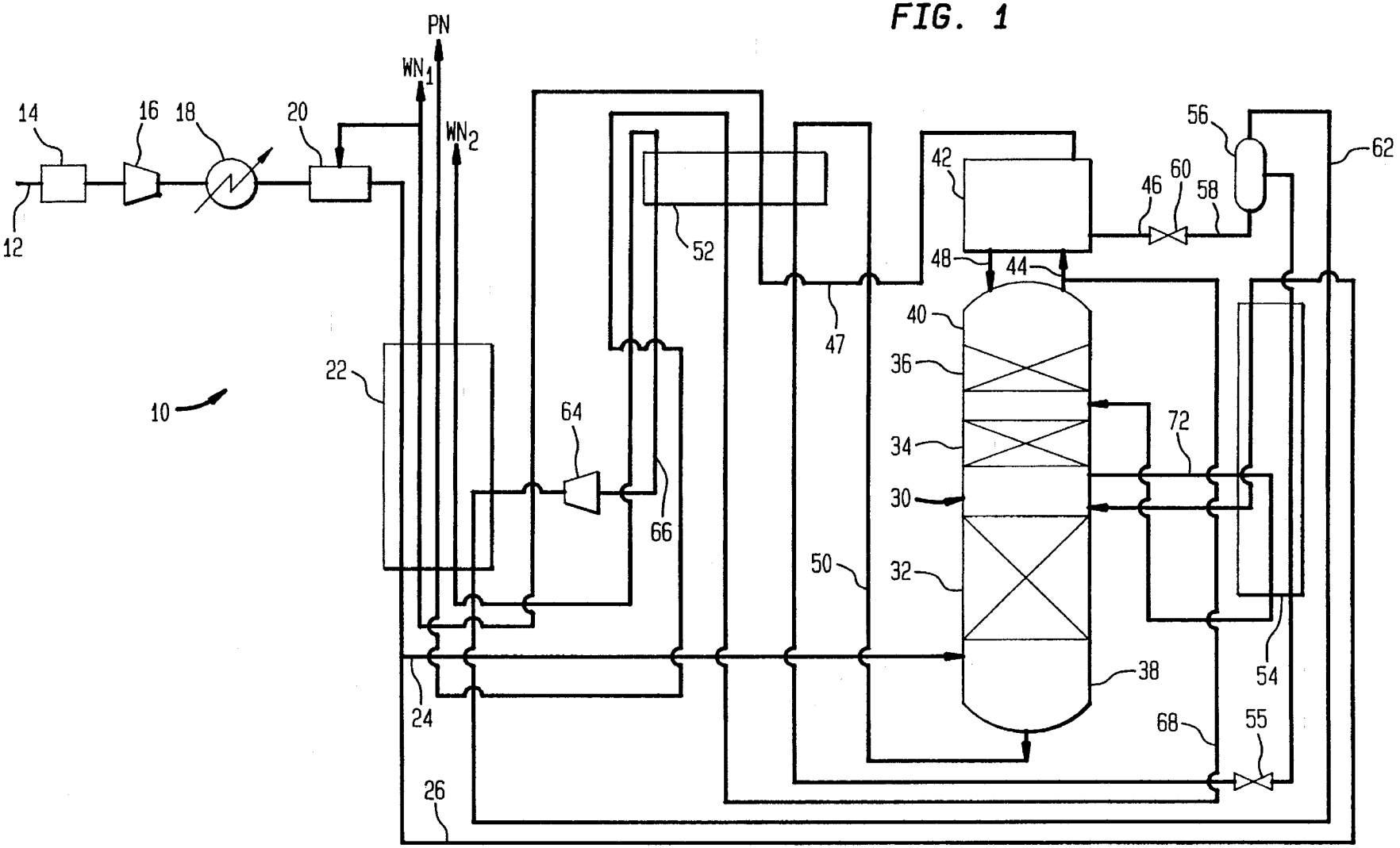
FIG. 1 is a schematic illustration of an air separation plant operating in accordance with a method and apparatus of the present invention.

With reference to FIG. 1, a single column nitrogen generator 10 is illustrated. An incoming air stream 12 is filtered by a filter 14 to remove dust particles and the like. Air stream 12, after having been filtered, is compressed by a compressor 16 and thereafter, the heat of compression is removed by a conventional after-cooler 18. Water, carbon dioxide and heavy trace components of the air such as hydrocarbons are removed by a pre-purification unit 20 connected to aftercooler 18. Pre-purification unit 20 can comprise several beds of adsorbent operating out of phase for regeneration purposes.

Air stream 12 having thus been filtered and purified is then introduced into a main heat exchanger 22. The air to be separated enters main heat exchanger 22 and is then fully cooled to a temperature suitable for its rectification. In this regard, the term "fully cooled" as used herein and in the claims means cooled to a temperature at which the rectification is conducted. The term "fully warmed" as used herein and in the claims means warmed to a temperature of the warm end of main heat exchanger 22. The term "partially warmed" means warmed to a temperature above the rectification temperature but below the temperature of the warm end of main heat exchanger 22.

After having been fully cooled within main heat exchanger 22, air stream 12 is then divided into first and second subsidiary streams 24 and 26 respectively. A junction, formed by T-sections of pipe, headers and the like, is connected to main heat exchanger for this purpose. First subsidiary stream 24 constitutes a major portion of the air to be separated and is introduced into a single distillation column 30 which is provided by liquid-vapor contacting elements 32, 34 and 36 which can be trays and/or structured packing, random packing and etc. Distillation column 30 rectifies the incoming air into an oxygen rich liquid column bottoms that collects within bottom region 38 of distillation column 30 and a nitrogen rich vapor tower overhead which collects in a top region 40 of distillation column 30. A head condenser 42 is connected to distillation column 30 to condense at least part of the nitrogen rich vapor tower overhead collected in top region 40 of distillation column 30. To this end, part of a nitrogen vapor stream 44 is extracted from top region 40 of distillation column 30 and is introduced into head condenser 42. Nitrogen vapor stream 44 is in part condensed by a coolant stream 46, which in turn vaporizes to produce a vaporized coolant stream 47. After condensation, nitrogen vapor stream 44 is returned as a reflux stream 48 and to top region 40 of distillation column 30.

An oxygen enriched liquid stream 50, composed of the oxygen rich liquid column bottoms, is extracted from bottom region 38 of distillation column 30. Oxygen enriched liquid stream 50 can then be preferably subcooled within a subcooler unit 52 to minimize vapor formation upon subsequent valve expansion. Thereafter, oxygen enriched liquid stream 50 is partially vaporized within a vaporizer 54 after having passed through a pressure reduction valve 55 (described in more detail hereinafter) and then introduced into a phase separator 56 to separate oxygen enriched liquid stream 50 into liquid and vapor phases.

A liquid phase stream 58 composed of the liquid phase is extracted from phase separator 56 and is then passed through a pressure reduction valve 60 to sufficiently lower the temperature of liquid phase stream 58 that it can serve as the coolant for head condenser 42. Thus, liquid phase stream 58 after passage through pressure reduction valve 60 is converted into coolant stream 46 which has been discussed hereinabove.

Phase separator 56 is also connected to the main heat exchanger 22 so that a vapor phase stream 62, composed of the vapor phase, partially warms within main heat exchanger 22. Vapor phase stream 62 after having been partially warmed is expanded in a turboexpander 64 or other expansion machine connected to main heat exchanger 22. The expansion of vapor phase stream 62 produces a refrigerant stream 66.

In the illustrated embodiment, refrigerant stream 66 also partially warms within subcooler unit 52 as does vaporized coolant stream 47 and a product stream 68. As illustrated, vaporized coolant stream 47, after subcooler unit 52, fully warms within main heat exchanger 22 to form a waste nitrogen stream labelled $WN_1$. Part of warm vaporized coolant stream 47 can be fed to pre-purification unit 20 for bed regeneration purposes. Main heat exchanger 22 is in communication with turboexpander 64 so that refrigerant stream 66 eventually fully warms within main heat exchanger 22 and is discharged as a waste stream, designated as $WN_2$. A product stream 68 is formed which is composed of the nitrogen vapor tower overhead collected in top region 40 of distillation column 30. Product stream 68 constitutes a remaining portion of the nitrogen vapor tower overhead that is not used in forming reflux to distillation column 30. After partial warming in subcooling unit 52, product stream 68 fully warms within main heat exchanger 22 and is discharged as a product stream, labelled PN. Against the partial warming of the foregoing mentioned steams, as mentioned previously, oxygen enriched liquid stream 50 subcools.

In single column nitrogen generator 10 oxygen enriched liquid stream 50 is partially vaporized in vaporizer 54 and thus, only part of oxygen enriched liquid stream 50 is used as coolant for head condenser 42. As a result, there is less reflux contributed through condensation of tower overhead in single column nitrogen generator 10 than in a nitrogen generator of the prior art. If no other reflux were added (an operation contemplated by the subject invention) a nitrogen generator of the present invention would have a lower production rate and/or produce nitrogen at a lower purity than a prior art design. However, the present invention also contemplates an operational embodiment in which a compensation for such reduced reflux is effected by the provision of intermediate reflux streams introduced into lower portions of distillation column 30 where additional liquid reflux is particularly needed.

The intermediate reflux allows single column nitrogen generator 10 to have the same production rate of product and purity as could be expected in a similar prior art plant design. To this end, second subsidiary stream 26 is liquefied within vaporizer 54. In order for there to be a temperature difference between oxygen enriched liquid stream 50, after having been subcooled, and second subsidiary stream 26, pressure reduction valve 55 is provided to reduce the pressure and thereby the temperature of oxygen enriched liquid stream 50. This reduction in pressure of oxygen enriched liquid stream 50 is below the pressure of distillation column 30 and yet results in a sufficient pressure for oxygen enriched liquid stream 50 that vapor stream 62, derived therefrom, can serve in a refrigeration role. At lower distillation column pressures, for instance, below 8 bar(a), additional reflux to distillation column 30 is produced by liquefaction of a vapor stream 72 extracted from distillation column 30 at about the same point as second stream 26, after liquefaction, is introduced into distillation column 30. Vapor stream 72 is then liquefied within vaporizer 54 and introduced as additional reflux above the point of introduction of the liquefied second subsidiary stream 26. As is evident, pressure reduction valve 55 also serves to provide a temperature difference between oxygen enriched liquid stream 50 and vapor stream 72.

A possible variation to apparatus 10 involves operation of distillation column 30 at high pressure. In such case, an expansion machine might also be attached to coolant stream 46. This would increase total plant refrigeration and therefore the amount of liquid produced. Additionally, such turboexpander could also be used to drive a recycle compressor to recycle part of the oxygen enriched liquid contained within coolant stream 46 back into distillation column 30 to also increase production. As can also be appreciated, partial vaporization of oxygen enriched liquid stream 50 is not restricted to the illustrated embodiment in which partial vaporization is effected through liquefaction of a portion of the incoming air. For instance, in a proper low pressure column application, a stream from the column, not having the exact composition of liquid air, could be used in place of liquefied air.

Figure 2:
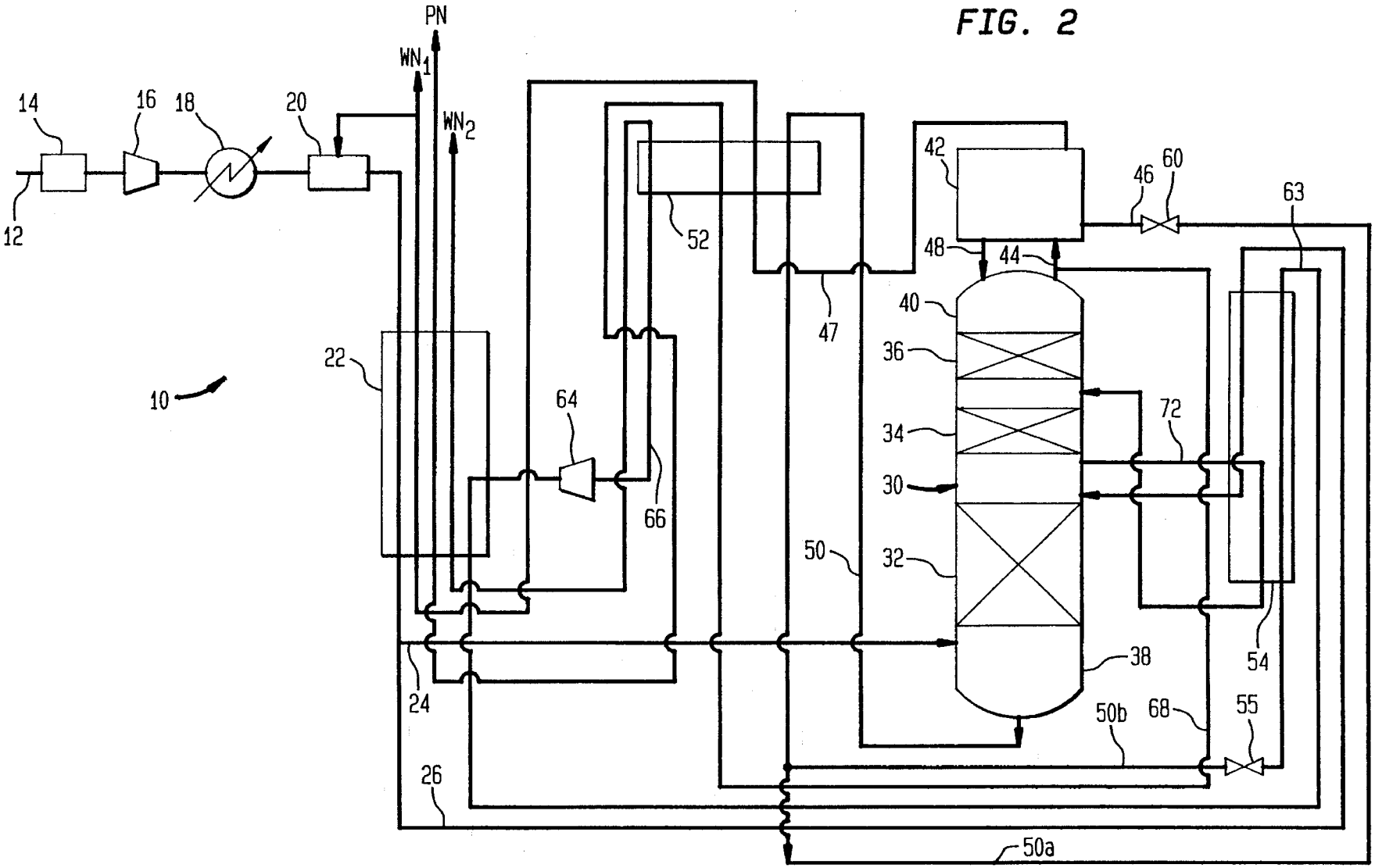
FIG. 2 is an alternative embodiment of FIG. 1. In order to avoid needless repetition in the explanation of FIG. 2, the numbering scheme used in FIG. 1 is carried over to FIG. 2 for components and streams that share common function.

With reference to FIG. 2, an alternative embodiment of single column nitrogen generator 10 is illustrated. In nitrogen generator 10, oxygen rich stream 50 after being subcooled within sub-cooler unit 52 is divided into first and second partial streams 50*a* and 50*b*. First partial stream 50*a* is expanded in first pressure reduction valve 60 to form coolant stream 46. Second partial stream 50*b* after having been expanded by pressure reduction valve 55 is then fully vaporized within vaporizer 54. The fully vaporized stream, designated by reference number 63, is then partially warmed within main heat exchanger 22 and expanded within turboexpander 64.

EXAMPLE 1

The following is a charted, calculated example of a possible operation of single column nitrogen generator 10 (illustrated in FIG. 1) in accordance with the present invention. In such example it is assumed that column 30 uses low pressure drop structured packing and has about 100 theoretical stages. Second partial stream 26 after having been liquefied is added to the distillation column at about six theoretical stages from the bottom. Stream 72 is withdrawn from the distillation column at a point of about six theoretical stages from the bottom and returned after condensing to a point about sixteen theoretical stages from the bottom of distillation column 30.

CHART FOR EXAMPLE 1

| Stream No. | Flow $Nm^3/hr$ | Condition Liquid Vapor | Temperature K. | Pressure bar (a) | $O_2$ Content % or parts per million |
|---|---|---|---|---|---|
| 12 | 13,400 | V | 305 | 1.01 | 20.96 |
| 24 | 11,739 | V | 93.0 | 3.17 | 20.96 |
| 26 | 1,454 | V | 93.0 | 3.17 | 20.96 |
| 47 | 3,901 | V | 87.6 | 1.21 | 53.32 |
| 50 | 6,670 | L | 92.6 | 3.17 | 41.92 |
| 58 | 3,901 | L | 90.1 | 2.27 | 53.32 |
| 62 | 2,768 | V | 90.1 | 2.27 | 25.85 |
| 66 | 2,768 | V | 83.0 | 1.09 | 25.85 |
| 68 | 6,670 | V | 88.3 | 3.10 | 2 ppm |
| 72 | 1,454 | V | 90.6 | 3.17 | 9.33 |

It is to be noted that in such example the letter "L" indicates a liquid condition and the letter "V" indicates a vapor condition. Top product purity, nitrogen recovery as fraction of the air feed, and addition and withdrawal points are sensitive to the physical properties of the data base employed in effectuating the calculations. Losses inherent in operation of the pre-purification unit have been included in stream 12. As would be appreciated by those skilled in the art, subcooler 52 would be at a low elevation with respect to the sump of distillation column 30.

Thus, in a prior art design making a gaseous nitrogen product, identical in quantity, fractional recovery from air, purity and pressure, where a turboexpander makes refrigeration by expanding air into the distillation column, stream 12 would normally be compressed to about 3.94 bar(a). In the present invention, air compression will only be to about 3.45 bar(a).

EXAMPLE 2

The following is a charted, calculated example of a possible operation of single column nitrogen generator 10 (illustrated in FIG. 2) in accordance with the present invention. In such example it is assumed that column 30 uses low pressure drop structured packing and has about 100 theoretical stages. Second partial stream 26 after having been liquefied is added to the distillation column at about six theoretical stages from the bottom. Stream 72 is withdrawn from the distillation column at a point of about six theoretical stages from the bottom and returned after condensing to a point about sixteen theoretical stages from the bottom of distillation column 30.

CHART FOR EXAMPLE 2

| Stream No. | Flow $Nm^3/hr$ | Condition Liquid Vapor | Temperature K. | Pressure bar (a) | $O_2$ Content % or parts per million |
|---|---|---|---|---|---|
| 12 | 13,400 | V | 305 | 1.01 | 20.96 |
| 24 | 11,259 | V | 92.6 | 3.10 | 20.96 |
| 26 | 2,080 | V | 92.6 | 3.10 | 20.96 |
| 47 | 3,889 | V | 86.3 | 1.21 | 41.92 |
| 50 | 6,669 | L | 92.4 | 3.10 | 41.92 |
| 50a | 3,889 | L | 87.0 | 3.03 | 41.92 |
| 63 | 2,780 | V | 92.1 | 2.18 | 41.92 |
| 66 | 2,780 | V | 85.2 | 1.06 | 41.92 |
| 68 | 6,670 | V | 88.0 | 3.03 | 4.8 ppm |
| 72 | 1,008 | V | 90.3 | 3.09 | 9.06 |

While the present invention has been described with reference to a preferred embodiment, it will be understood by those skilled in the art that numerous changes, additions, and omissions may be made without departing from he spirit and scope of the present invention.

I claim:

1. A method of separating air to produce a nitrogen product comprising:

separating the air by a low temperature rectification process employing a distillation column to produce an oxygen rich liquid column bottoms and a nitrogen rich vapor tower overhead and a head condenser to condense at least part of the nitrogen rich vapor tower overhead to reflux said distillation column;

said low temperature rectification process including:

partially vaporizing an oxygen enriched liquid stream composed of said oxygen rich liquid column bottoms;

separating said oxygen enriched liquid stream into liquid and vapor phases;

expanding a liquid phase stream composed of the liquid phase to create a temperature difference between said liquid phase stream and said nitrogen rich vapor tower overhead and introducing said liquid phase stream as a coolant stream into said head condenser so that heat is transferred from said at least part of the nitrogen rich vapor to said coolant stream thereby causing said condensation of said at least part of said nitrogen rich vapor tower overhead;

expanding a vapor phase stream composed of the vapor phase with the performance of work to produce a refrigerant stream utilized to at least partially refrigerate said low temperature rectification process; and extracting a product stream from a remaining part of said nitrogen rich vapor tower overhead not utilized in said distillation column as said reflux to form said nitrogen product.

2. The method of claim 1, wherein:

said oxygen enriched liquid stream is partially vaporized by indirectly exchanging heat with part of the air to be separated, thereby causing said part of the air to be separated to liquefy;

said part of the air to be separated is introduced into said distillation column as intermediate reflux to maintain production of said product stream at a level that would have been obtained had the entire oxygen enriched liquid stream been utilized to condense said at least part of said nitrogen rich vapor tower overhead; and prior to said partial vaporization of said oxygen enriched liquid stream, said oxygen enriched liquid stream is expanded to produce a temperature difference for said indirect heat exchange between said part of said air and said oxygen enriched liquid stream.

3. The method of claim 2, further comprising:

removing a vapor stream from said distillation column;

condensing said vapor stream by indirectly exchanging further heat between said vapor stream and said oxygen enriched stream; and introducing said vapor stream back into said distillation column, above said intermediate reflux, as additional reflux.

4. A method of separating air to produce a nitrogen product comprising:

separating the air by a low temperature rectification process employing a distillation column to produce an oxygen rich liquid column bottoms and a nitrogen rich vapor tower overhead and a head condenser to condense at least part of the nitrogen rich vapor tower overhead to reflux said distillation column;

said low temperature rectification process including:

dividing an oxygen enriched liquid stream composed of said oxygen rich liquid column bottoms into first and second partial streams;

expanding said first partial stream to create a temperature difference between said first partial stream and said nitrogen rich vapor tower overhead and introducing said first partial stream as a coolant stream into said head condenser so that heat is transferred from said at least part of the nitrogen rich vapor to said coolant stream thereby causing said condensation of said at least part of said nitrogen rich vapor tower overhead;

vaporizing said second partial stream;

expanding said second partial stream with the performance of work to produce a refrigerant stream utilized to at least partially refrigerate said low temperature rectification process; and extracting a product stream from a remaining part of said nitrogen rich vapor tower overhead not utilized in said distillation column as said reflux to form said nitrogen product.

5. The method of claim 4, wherein:

said second partial stream is vaporized by indirectly exchanging heat with part of the air to be separated, thereby causing said part of the air to be separated to liquefy;

said part of the air to be separated is introduced into said distillation column as intermediate reflux to maintain production of said product stream at a level that would have been obtained had an amount of flow equal to both said first and second partial streams been utilized to condense said at least part of said nitrogen rich vapor tower overhead; and prior to said vaporization of said second partial stream, said second partial stream is expanded to produce a temperature difference for said indirect heat exchange between said part of said air and said second partial stream.

6. The method of claim 5, further comprising:

removing a vapor stream from said distillation column;

condensing said vapor stream by indirectly exchanging further heat between said vapor stream and said second partial stream; and introducing said vapor stream back into said distillation column, above said intermediate reflux, as additional reflux.

7. The method of claim 3 or claim 6, wherein:

said oxygen enriched liquid stream is subcooled within a subcooling unit prior to being partially vaporized;

said heat transfer to said coolant stream vaporizes said coolant stream to form a vaporized coolant stream;

said air to be separated is divided into first and second subsidiary streams;

said first subsidiary stream is introduced into said distillation column;

said second subsidiary stream forms said part of said air to be separated;

said oxygen enriched stream is subcooled through additional heat exchange with said refrigerant stream, said product stream, and said vaporized coolant stream within a subcooling unit; and said refrigerant, vaporized coolant and said product streams are partially warmed within said subcooling unit and are then fully warmed.

8. An apparatus for separating air to produce a nitrogen product, said apparatus comprising:

a filter for filtering the air;

a compressor connected to the filter for compressing the air;

an after-cooler for removing heat of compression from the air;

a pre-purification unit for purifying the air;

main heat exchange means for cooling the air to a temperature suitable for its rectification;

a distillation column configured to rectify the air into an oxygen rich liquid column bottoms and a nitrogen rich vapor tower overhead;

a head condenser connected to said distillation column to condense at least part of the nitrogen rich vapor tower overhead to reflux said distillation column;

vaporization means for partially vaporizing an oxygen enriched liquid stream composed of said oxygen enriched liquid column bottoms;

a phase separator connected to said vaporization means for separating said oxygen enriched liquid stream into liquid and vapor phases;

said phase separator connected to said head condenser so that heat is transferred from said at least part of the nitrogen rich vapor to a coolant stream made up of a liquid phase stream composed of said liquid phase, thereby causing said condensation of said at least part of said nitrogen rich vapor tower overhead and vaporization of said coolant stream to form a vaporized coolant stream;

a pressure reduction valve interposed between said phase separator and said head condenser to expand said liquid phase stream and thereby create said coolant stream and a temperature difference between said coolant stream and said nitrogen rich vapor tower overhead;

said phase separator also connected to said main heat exchange means so that a vapor phase stream composed of said vapor phase partially warms;

expansion means connected to said main heat exchange means for expanding said vapor phase stream with the performance of work to produce a refrigerant stream;

said main heat exchange means in communication with said expansion means so that said refrigerant stream fully warms within said main heat exchange means;

means for extracting a product stream composed of a remaining part of said nitrogen rich vapor tower overhead not utilized in said distillation column as said reflux to form said nitrogen product; and said main heat exchange means connected to said product stream extracting means so that said product stream fully warms within said main heat exchange means.

9. The apparatus of claim 8, wherein:

said vaporization means is connected to said main heat exchange means and has means for indirectly exchanging heat between said oxygen enriched liquid stream and said part of said air to be separated so that said oxygen enriched liquid stream is partially vaporized and said part of the air to be separated liquefies and a first pressure reduction valve configured to expand said oxygen enriched liquid stream to produce a temperature difference for said indirect heat exchange between said part of said air and said oxygen enriched liquid stream;

said pressure reduction valve interposed between said phase separator and said head condenser constituting a second pressure reduction valve; and said vaporization means is connected to said distillation column so that said part of the air to be separated is introduced into said distillation column as intermediate reflux to maintain production of said product stream at a level that would have been obtained had the entire oxygen rich liquid stream been utilized to condense said at least part of said nitrogen rich vapor tower overhead.

10. The apparatus of claim 9, further comprising said vaporization means also having means for indirectly exchanging further heat between a vapor stream and said oxygen rich liquid stream so that said vapor stream condenses and said vaporization means connected to said distillation column so that said vapor stream flows from said distillation column into said vaporization means and thereafter returns to said distillation column, above said intermediate reflux, as additional reflux.

11. An apparatus for separating air to produce a nitrogen product, said apparatus comprising:

a filter for filtering the air;

a compressor connected to the filter for compressing the air;

an after-cooler for removing heat of compression from the air;

a pre-purification unit for purifying the air;

main heat exchange means for cooling the air to a temperature suitable for its rectification;

a distillation column configured to rectify the air into an oxygen rich liquid column bottoms and a nitrogen rich vapor tower overhead;

a head condenser connected to said distillation column for condensing at least part of the nitrogen rich vapor tower overhead to reflux said distillation column against vaporizating a coolant stream made up of a first partial stream composed of said oxygen rich liquid column bottoms, thereby to form a vaporized coolant stream;

a pressure reduction valve connected to said head condenser to expand said first partial stream and thereby to create said coolant stream and a temperature difference between said coolant stream and said nitrogen rich vapor tower overhead;

vaporization means for vaporizing a second partial stream composed of said oxygen rich liquid column bottoms;

said vaporization means connected to said main heat exchange means so that said second partial stream partially warms;

expansion means connected to said main heat exchange means for expanding said second partial stream with the performance of work to produce a refrigerant stream;

said main heat exchange means in communication with said expansion means so that said refrigerant stream fully warms within said main heat exchange means;

means for extracting a product stream composed of a remaining part of said nitrogen rich vapor tower overhead not utilized in said distillation column as said reflux to form said nitrogen product; and said main heat exchange means connected to said product stream extracting means so that said product stream fully warms within said main heat exchange means.

12. The apparatus of claim 11, wherein:

said vaporization means is connected to said main heat exchange means and has means for indirectly exchanging heat between said second partial stream and a part of said air to be separated so that said second partial steam is vaporized and said part of the air to be separated liquefies and a first pressure reduction valve configured to expand said second partial stream to produce a temperature difference for said indirect heat exchange between said part of said air and said second partial stream;

said pressure reduction valve interposed between said sub-cooling unit and said head condenser constitutes a second pressure reduction valve; and said vaporization means is connected to said distillation column so that said part of the air to be separated is introduced into said distillation column as intermediate reflux to maintain production of said product stream at a level that would have been obtained had an amount of flow equal to said first and second partial streams been utilized to condense said at least part of said nitrogen rich vapor tower overhead.

13. The apparatus of claim 12, further comprising said vaporization means also having means for indirectly exchanging further heat between a vapor stream and said second partial stream so that said vapor stream condenses and said vaporization means connected to said distillation column so that said vapor stream flows from said distillation column into said vaporization means and thereafter returns to said distillation column, above said intermediate reflux, as additional reflux.

14. The apparatus of claim 8 or claim 11, further comprising:

a subcooling unit interposed between said distillation column and said head condenser for subcooling said oxygen enriched liquid stream;

a junction connected to said heat exchange means so that said air to be separated is divided into first and second subsidiary streams;

said junction connected to said distillation column so that said first subsidiary stream flows into said distillation column and said junction also connected to vaporization means so that said part of said air to be separated is formed by said second subsidiary stream; and said main heat exchange means configured for fully warming said refrigerant, vaporized coolant and said product streams and connected to said subcooling unit so that said refrigerant, vaporized coolant and said product streams partially warm within said subcooling unit and then fully warm therewithin.

* * * * *